US009688468B1

(12) United States Patent
Pethtel et al.

(10) Patent No.: US 9,688,468 B1
(45) Date of Patent: Jun. 27, 2017

(54) INDEXED MODULAR DIKE WALL

(71) Applicant: POLYSTAR INC., Stow, OH (US)

(72) Inventors: Mark R. Pethtel, Sagamore Hills, OH (US); Robert A. Frindt, Chardon, OH (US)

(73) Assignee: POLYSTAR INC., Stow, OH (US)

( * ) Notice: Subject to any disclaimer, the term of this patent is extended or adjusted under 35 U.S.C. 154(b) by 0 days.

(21) Appl. No.: 14/738,125

(22) Filed: Jun. 12, 2015

Related U.S. Application Data

(60) Provisional application No. 62/011,360, filed on Jun. 12, 2014.

(51) Int. Cl.

| | |
|---|---|
| ***E02B 3/10*** | (2006.01) |
| ***E01F 15/08*** | (2006.01) |
| ***B65D 90/24*** | (2006.01) |
| ***B65D 90/08*** | (2006.01) |

(52) U.S. Cl.
CPC ..... *B65D 90/24* (2013.01); *B65D 90/08* (2013.01); *E02B 3/106* (2013.01); *E01F 15/088* (2013.01)

(58) Field of Classification Search
CPC .. E02B 3/10; E02B 3/106; E02B 3/108; E01F 15/088
USPC ..... 405/114; 404/6
See application file for complete search history.

(56) References Cited

U.S. PATENT DOCUMENTS 5,454,195 A * 10/1995 Hallsten ..... B65D 90/24 220/495.01
6,012,872 A * 1/2000 Perry ..... E02B 3/108 220/1.6
6,059,491 A * 5/2000 Striefel ..... E01F 15/086 256/13.1
6,695,534 B2 * 2/2004 Cain ..... B65D 90/24 405/114
8,540,456 B2 9/2013 Marshall
2007/0098490 A1 * 5/2007 Christensen ..... E01F 13/022 404/6
2007/0110517 A1 * 5/2007 Wasserstrom ..... E01F 15/088 404/6
2008/0286041 A1 * 11/2008 Yodock, Jr. ..... E01F 15/083 404/6
2009/0003931 A1 * 1/2009 Christensen ..... B29C 49/482 404/6
2009/0060650 A1 * 3/2009 Kulp ..... E01F 15/088 404/6
2010/0129156 A1 * 5/2010 Taylor ..... E02B 3/108 405/114
2012/0315093 A1 * 12/2012 Taylor ..... E02B 3/108 405/114
2013/0277363 A1 10/2013 French
2014/0328620 A1 * 11/2014 Christensen ..... E01F 13/022 404/6

FOREIGN PATENT DOCUMENTS

CA 2674599 A1 5/2010
WO 2013158780 A1 10/2013

* cited by examiner

*Primary Examiner* — Frederick L Lagman
(74) *Attorney, Agent, or Firm* — Pearne & Gordon LLP

(57) ABSTRACT

A dike wall section for assembling a dike wall is taught. The dike wall section has an elongate body, a pin at a male end of the body; and a socket at the female end of the body, the pin and socket being operable to connect additional sections to the first section by a pin-in-socket connection having a vertical axis.

4 Claims, 5 Drawing Sheets

INDEXED MODULAR DIKE WALL

BACKGROUND OF THE INVENTION

The present invention relates to structures for containing leakage from storage devices and, in particular, to dike walls.

Dike walls are used to contain a material (typically a liquid) within a closed area on the ground or other substantially horizontal surface.

Typically, a sheet of impervious material is laid on the closed surface area defined by the dike wall, as well as over at least a portion of the dike wall, thus forming an open containment vessel. The impervious material is often a sheet of flexible plastic or other material suitable for containing the substance of interest.

Dike walls can be conveniently formed from connectable sections. Such sections are disclosed for example in U.S. Pat. No. 8,540,456, issued Sep. 24, 2014, which is incorporated herein by reference.

In the above cited patent, the dike wall is formed from a combination of straight sections and curved sections. This places substantial limits on the possible shape of the dike. In particular, it makes it difficult to go around obstructions.

SUMMARY OF THE INVENTION

The present invention includes an improved dike wall section. A dike wall section has an elongate body, a pin at a male end of the body; and a socket at the female end of the body, the pin and socket being operable to connect additional sections to the first section by a pin-in-socket connection having a vertical axis.

DESCRIPTION OF A PREFERRED EMBODIMENT

Figure 1:
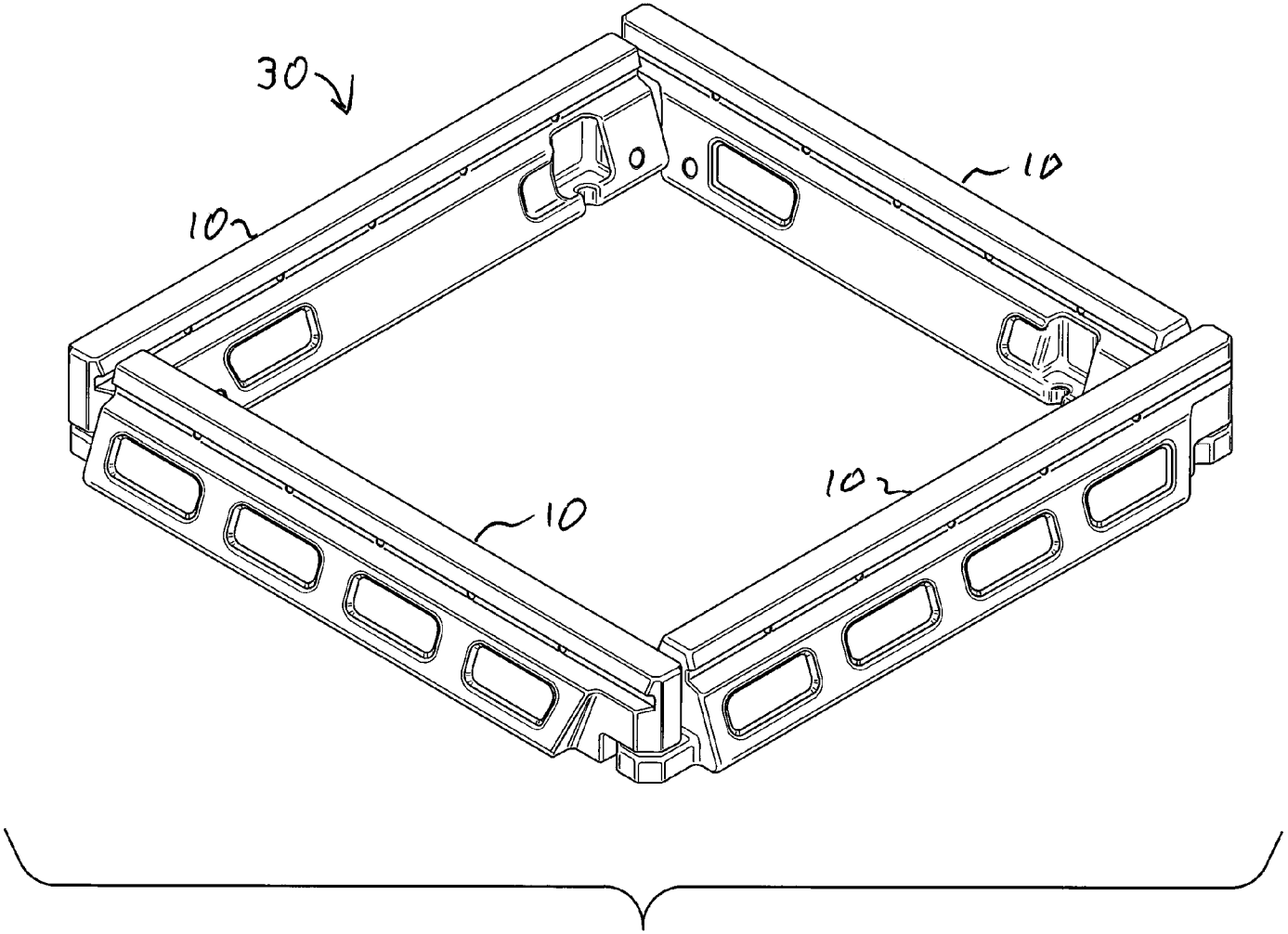
FIG. 1 is a perspective view from above of a completed dike wall formed from exemplary individual sections.
Figure 2:
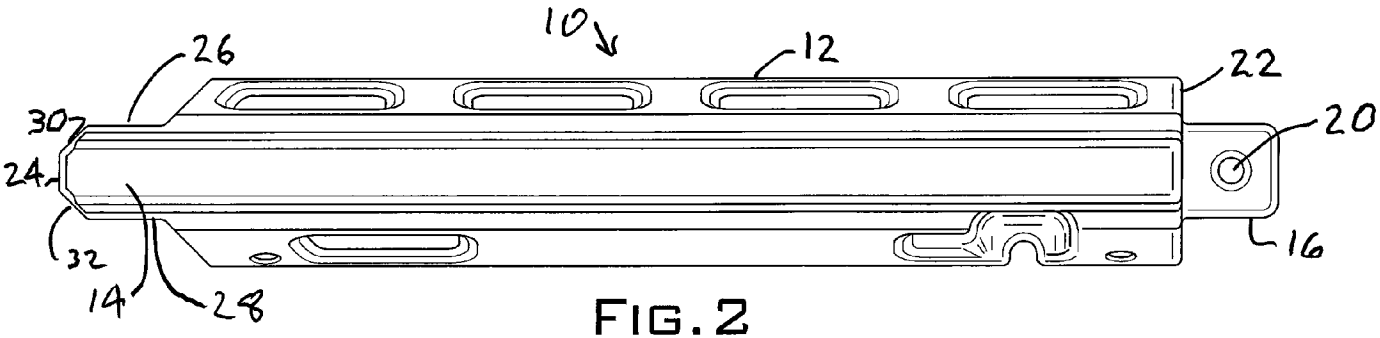
FIG. 2 is a top plan view of an example of a dike wall section according to an aspect of the invention.
Figure 3:
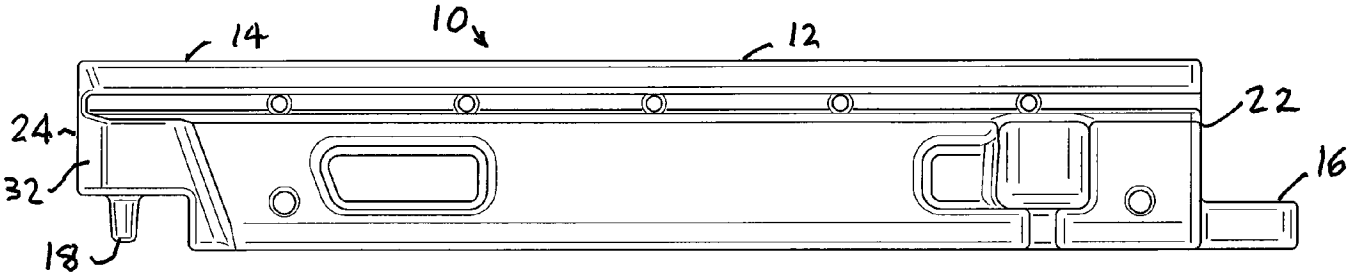
FIG. 3 is a rear elevation view of the dike wall section of FIG. 2.
Figure 4:
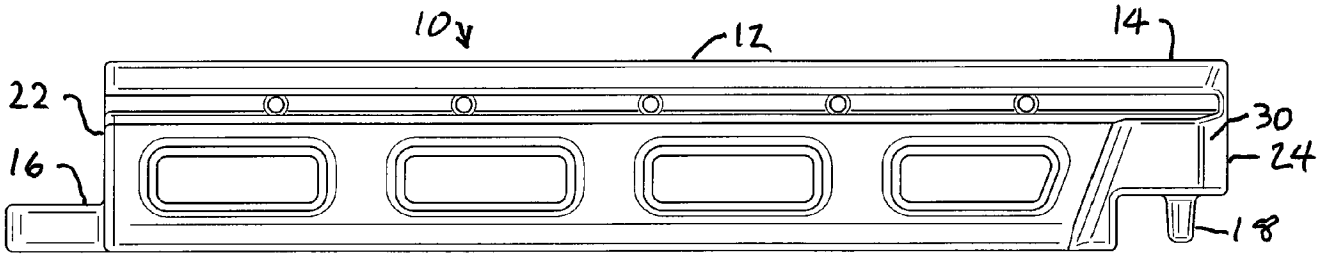
FIG. 4 is a front elevation view of the dike wall section of FIG. 2.
Figure 6:
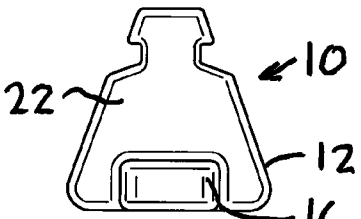
FIG. 6 is a right end elevation view of the dike wall section of FIG. 2.
Figure 5:
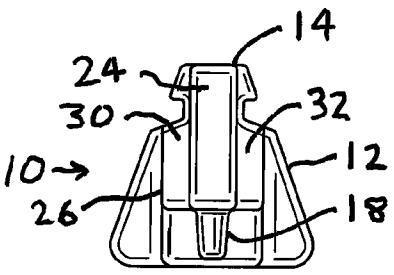
FIG. 5 is a left end elevation view of the dike wall section of FIG. 2.
Figure 7:
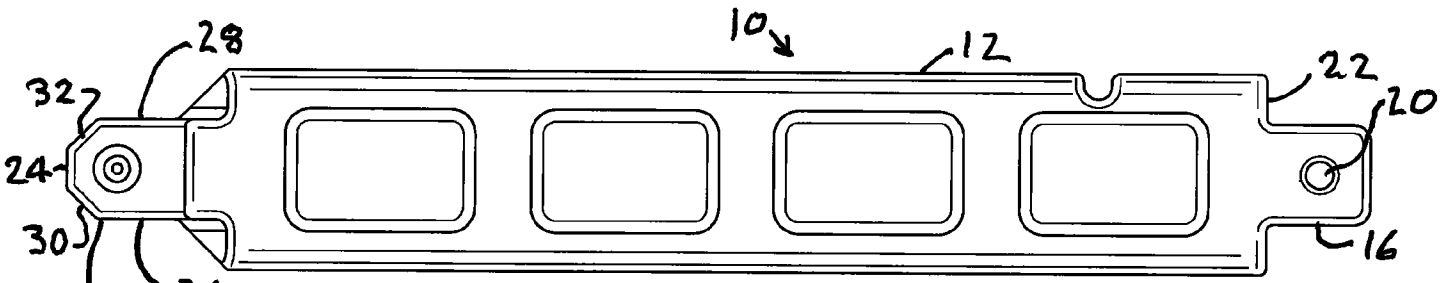
FIG. 7 is a bottom plan view of the dike wall section of FIG. 2.

Referring to FIGS. 2-7, a dike wall section 10 includes an elongate body 12 having a male end 14 and a female end 16.

The male end 14 has a downwardly extending pin 18. The female end 16 has a socket 20 for receiving the pin 18 of an additional section 10. When a pin 16 and a socket 18 are engaged, they form a pin-and-socket connection having a vertical axis.

The section 10 may be, for example, formed of plastic using rotational molding. An example of a commercially useful size includes a six foot length, a one foot height and a one foot base width.

The male end 14 and the female end 16 may advantageously include vertical index surfaces to establish a limited number of discrete horizontal angles at which a pair of sections may be joined by a pin 18 inserted in a socket 20. This provides easy layout of the desired dike shape during assembly. The examples in the drawings are limited to five angles: plus or minus zero, forty-five and ninety degrees.

It is of course possible to choose other angles. The number of useful angles is influenced by the material of the sections and the method of manufacture, as both the precision of joints and strength of the modules affect the choice. More precision and strength would allow for additional angles.

Figure 9:
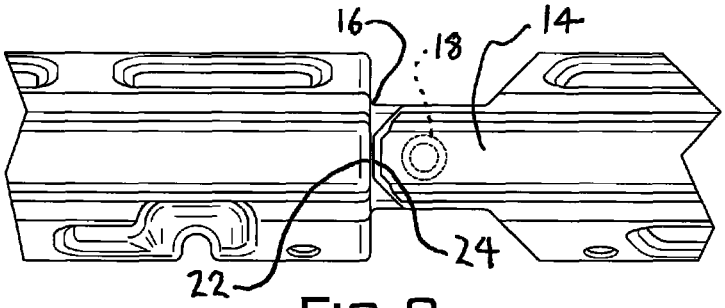
FIG. 9 is a partial top plan view of the joined dike wall sections of FIG. 8.
Figure 8:
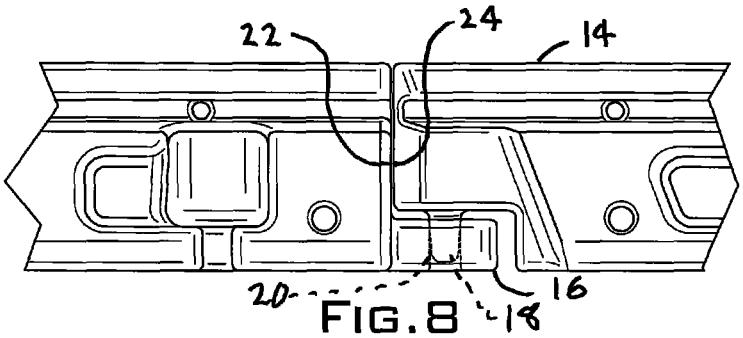
FIG. 8 is a partial rear elevation view of two of the dike wall sections of FIG. 2 joined at a zero degree horizontal angle.
Figure 10:
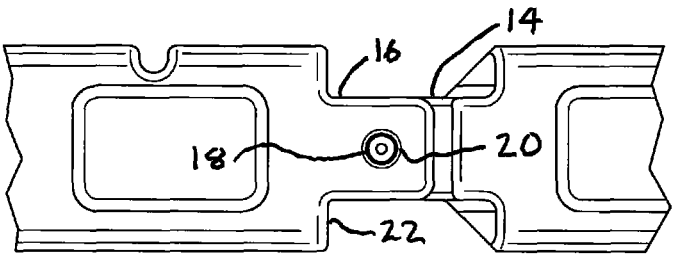
FIG. 10 is a partial bottom plan view of the joined dike wall sections of FIG. 8.

Referring to FIGS. 8-10, two of the sections are connected at a zero degree horizontal angle. The index surface 22 of the female end 16 engages the index surface 24 of the male end 14 once the pin 18 and socket 20 are engaged. This locks the connection at zero degrees.

Figure 11:
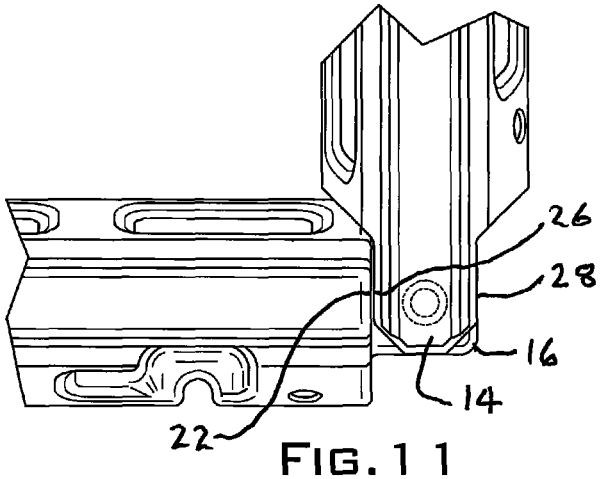
FIG. 11 is a partial top plan view of two of the dike wall sections of FIG. 2 joined at a plus (or minus) forty-five degree horizontal angle.

Referring to FIG. 11, two of the sections are connected at a plus ninety (minus ninety) degree horizontal angle. The index surface 22 of the female end 16 engages the index surface 26 (28 for minus) of the male end 14 once the pin 18 and socket 20 are engaged. This locks the connection at plus ninety (minus ninety) degrees.

Figure 12:
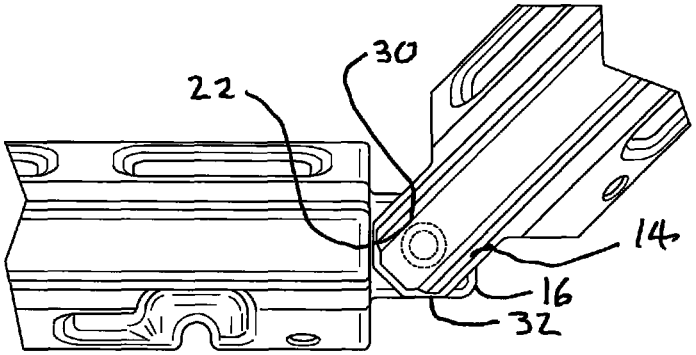
FIG. 12 is a partial top plan view of two of the dike wall sections of FIG. 2 joined at a plus (or minus) ninety degree horizontal angle.

Referring to FIG. 12, two of the sections are connected at a plus forty-five (minus forty-five) degree horizontal angle. The index surface 22 of the female end 16 engages the index surface 30 (32 for minus) of the male end 14 once the pin 18 and socket 20 are engaged. This locks the connection at plus forty-five (minus forty-five) degrees.

It is of course possible to have other embodiments that interchange the peg and socket between top and bottom and/or the index surfaces as well.

FIG. 1 illustrates an example dike wall 30 formed with dike wall sections 10.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A dike wall section, comprising:

an elongate body;

a pin at a male end of said body;

a socket formed in the female end of said body, said pin and socket being operable to connect additional sections to said section by a pin-in-socket connection having a vertical axis; and multiple vertical planar index surfaces on said male and female ends of said sections, wherein said male index surfaces and said female index surfaces cooperate to limit said pin-in-socket connection to forming only a discrete number between two and five angles between connected sections.

2. A dike wall according to claim 1, wherein said index surfaces limit connections between sections to forming zero and plus or minus forty-five and ninety degree horizontal angles between connected sections.

3. A dike wall, comprising:

a plurality of dike wall sections joined end-to-end to form a closed wall, a plurality of said dike wall sections being straight sections, each comprising:

an elongate body;

a pin at a male end of said body;

a socket formed in the female end of said body, said pin and socket being operable to connect additional straight sections to said section by a pin-in-socket connection having a vertical axis; and multiple vertical planar index surfaces on said male and female ends of said sections, wherein said male index surfaces and said female index surfaces cooperate to limit said pin-in-socket connection to forming only a discrete number between two and five horizontal angles between connected sections.

4. A dike wall according to claim 3, wherein said index surfaces limit connections between straight sections to forming zero and plus or minus forty-five and ninety degree horizontal angles between connected straight sections.

* * * * *